US008910457B2

(12) United States Patent
Lagares Corominas

(10) Patent No.: US 8,910,457 B2
(45) Date of Patent: Dec. 16, 2014

(54) APPARATUS AND METHOD FOR CUTTING SLICES OF A FOOD PRODUCT AND LOADING THEM ON A CONVEYING SURFACE, AND TREATMENT PLANT INCLUDING SAID APPARATUS

(75) Inventor: Narcis Lagares Corominas, Girona (ES)

(73) Assignee: Metalquimia, S.A. (ES)

( * ) Notice: Subject to any disclaimer, the term of this patent is extended or adjusted under 35 U.S.C. 154(b) by 353 days.

(21) Appl. No.: 13/265,017

(22) PCT Filed: Apr. 26, 2010

(86) PCT No.: PCT/IB2010/000951

§ 371 (c)(1),
(2), (4) Date: Nov. 16, 2011

(87) PCT Pub. No.: WO2010/125441

PCT Pub. Date: Nov. 4, 2010

(65) Prior Publication Data

US 2012/0180438 A1 Jul. 19, 2012

(30) Foreign Application Priority Data

Apr. 29, 2009 (EP) ..... 09380090

(51) Int. Cl.
*B26D 7/32* (2006.01)
*B26D 7/06* (2006.01)

(52) U.S. Cl.
CPC ..... *B26D 7/32* (2013.01); *B26D 7/0625* (2013.01); *B26D 2210/02* (2013.01)
USPC ..... 53/513; 198/436; 198/431; 83/155

(58) Field of Classification Search
CPC .... B26D 7/32; B26D 7/0625; B26D 2210/02; B65G 47/71
USPC ..... 53/513, 514, 435, 517, 448, 543; 198/431, 432, 433, 426, 418.7
See application file for complete search history.

(56) References Cited

U.S. PATENT DOCUMENTS 1,807,313 A * 5/1931 Hines ..... 83/77
4,684,008 A * 8/1987 Hayashi et al. ..... 198/436

(Continued)

FOREIGN PATENT DOCUMENTS

DE 4319171 A1 12/1994
FR 2839496 A 11/2003

(Continued)

*Primary Examiner* — Andrew M Tecco
(74) *Attorney, Agent, or Firm* — Hess Patent Law Firm LLC; Robert J. Hess

(57) ABSTRACT

The apparatus includes a slicing machine (1) for cutting rows of slices (A) from several pieces of food product, and a loading unit (2) comprising a set of array-forming conveyor belts (7*a*, 7*b*, 7*c*) arranged in parallel, a device for aligning each of the array-forming conveyor belts (7*a*, 7*b*, 7*c*) with the slicing machine (1) for receiving successive rows of slices (A) arranged in a direction transverse to the forward movement direction while the array-forming conveyor belt is made to move forward synchronously with the operation of the slicing machine (1) until forming a partial array of slices (A) on each array-forming conveyor belt, and a transfer device for transferring a complete array of slices (A) formed by the partial arrays from the array-forming conveyor belts (7*a*, 7*b*, 7*c*) to a moving conveying surface.

14 Claims, 6 Drawing Sheets

(56) References Cited

U.S. PATENT DOCUMENTS

| | | | | |
|---|---|---|---|---|
| 4,913,019 | A * | 4/1990 | Hayashi | 83/367 |
| 7,357,953 | B1 * | 4/2008 | Van Den Dungen et al. | 426/465 |
| 7,581,474 | B2 * | 9/2009 | Weber | 83/29 |
| 2004/0016331 | A1 | 1/2004 | Wolcott | |
| 2004/0031363 | A1 | 2/2004 | Lindee | |
| 2004/0072524 | A1 * | 4/2004 | Van Den Dungen et al. | 452/51 |

FOREIGN PATENT DOCUMENTS

| | | | |
|---|---|---|---|
| WO | 00/59690 | A | 10/2000 |
| WO | 02/22446 | A | 3/2002 |

* cited by examiner

APPARATUS AND METHOD FOR CUTTING SLICES OF A FOOD PRODUCT AND LOADING THEM ON A CONVEYING SURFACE, AND TREATMENT PLANT INCLUDING SAID APPARATUS

FIELD OF THE ART

The present invention relates to an apparatus and a method for cutting slices of a food product and loading them on a conveying surface, applicable to a food product treatment plant and more particularly to a plant for accelerated drying and maturing a sausage meat product cut into slices. The present invention also relates to a treatment plant including said apparatus for cutting slices of a food product and loading them on a conveying surface.

BACKGROUND OF THE INVENTION

Installations and methods for treating a food product cut into slices are known in the state of the art. For example, international patent application WO 2005/092109 describes a method for drying and maturing a sausage meat product cut into slices. Slicing machines capable of cutting slices of several pieces of a food product at the same time at a high speed are also known, such as, for example, the Weber 604 slicer. To subject the slices to treatment it is known, for example, from international patent application WO 2008135616, to arrange the slices in a single layer ordered formation on a system of conveyor belts moving the slices along a path including the passage through one or more treating units, such as, for example, a forced convection treating unit or a vacuum treating unit. However, this application neither describes nor suggests an apparatus or method for transferring the slices of food product from a large capacity slicer to a conveying surface of the system of conveyor belts in a single layer ordered formation.

The author of the present application has developed a food product treatment plant of the type described in which, in order to ensure that the slices are kept in the ordered formation while they are conveyed along the path, the slices are arranged in a single layer on large trays provided with a permeable support surface, and the trays loaded with the slices are conveyed by means of a conveyor device along the path including the passage through the one or more treating units. At the end of the treating line, the slices are unloaded from the trays in an unloading unit and directed to a packaging unit in which they are conditioned and packaged, whereas the empty trays are again directed by a conveyor towards the loading unit, passing through a tray washing unit. Nevertheless, an apparatus or process for transferring the slices from a large capacity slicer to the large trays at a sufficient speed to continuously supply one or more treating lines has not been described.

Patent FR-A-2839496 describes a process and an installation for the automatic production of food products from slices coming out of a slicing machine. The process comprises depositing the slices at a constant rate on a conveyor belt driven at a predetermined speed to obtain, at the end of the conveyor belt, an ejection and dropping of the slices onto a moving receiving tray, and synchronizing the movement of the receiving tray according to the dropping rate of the slices in order to distribute the slices on the tray according to a predetermined positioning. In this case, the tray forms part of a package for the slices and is small in size; therefore the process or the installation does not solve the problem of loading large trays at a high speed.

International patent application WO 02/22446 describes a device using several conveyor belts for conveying slices of a food product coming from a slicing machine, forming groups of partially overlapping slices and loading said groups of partially overlapping slices in trays for their packaging. Nor is the problem of loading trays at a high speed solved in this document.

Document US 2004/0016331 A1 discloses a slicing machine system comprising a slicing machine that slices several pieces of cured food product and deposits rows of slices on a single conveyor belt which moves in a forward direction at a speed synchronized with the operation of the sliding machine so that several lines of partially superimposed slices are formed in the longitudinal direction on the conveyor belt. A conveying system is provided for joining together the lines of slices to form a single line of partially superimposed slices in the longitudinal direction ready for packaging. A drawback of this slicing machine system is that is not able to form a complete array of slices having a number of slices in each transverse row greater than the number of pieces of food product that are sliced at once by the slicing machine, and wherein the slices, which are of a raw and uncured food product, are arranged in a single layer ready for a further treatment.

Document US 2004/031363 A1 discloses a slicing and conveying system that includes a slicing blade that cuts slices from a loaf, and an output conveyor located below the slicing blade for receiving the slices in a draft. A control system automatically adjusts a lateral movement of the output conveyor to form a laterally shingled draft of a consistent width in response to a sensed lateral dimension of the loaf being sliced. A drawback with this slicing machine is that it is not able to form several partial arrays of slices arranged in a single layer on different parallel conveyors configured to transfer the partial arrays onto an output conveyor to form a complete array of slices arranged in a single layer thereon.

DISCLOSURE OF THE INVENTION

According to a first aspect, the present invention provides an apparatus for cutting slices of a food product and loading them on a conveying surface. The apparatus is of the type comprising a slicing machine for cutting slices from at least one piece of food product, and a loading unit including at least one conveyor belt for receiving said slices from said slicing machine and loading them on a moving conveying surface. The apparatus of the present invention is characterized in that said slicing machine is adapted for cutting successive rows of slices from a number of pieces of food product arranged in parallel, and in that said loading unit comprises a set of array-forming conveyor belts arranged in parallel, movement means for aligning the start of each of said array-forming conveyor belts with an outlet of said slicing machine for receiving successive rows of slices arranged in a direction transverse to the forward movement direction on each array-forming conveyor belt while the same is made to move forward synchronously with the operation of the slicing machine until forming a partial array of slices on each of the array-forming conveyor belts, and transfer means for transferring said partial arrays, which together form a complete array of slices, from the array-forming conveyor belts to said moving conveying surface.

The mentioned transfer means of the loading unit can be provided by the movement of the array-forming conveyor belts actuated in unison for transferring the respective partial arrays directly to the moving conveying surface. In a preferred embodiment, the transfer means comprise a transfer conveyor belt with a width equivalent to the combined widths of the array-forming conveyor belts. This transfer conveyor belt is arranged for receiving said complete array of slices formed by the partial arrays coming from the array-forming conveyor belts, and for then transferring it to the moving conveying surface. In another embodiment, in order to achieve an intermediate buffer effect, the transfer means of the loading unit further comprise an intermediate conveyor belt with a width equivalent to the combined widths of the array-forming conveyor belts and to the width of the transfer conveyor belt. This intermediate conveyor belt is arranged for receiving at the same time the respective partial arrays of slices from the end of the array-forming conveyor belts for the purpose of forming together a complete array of slices on said intermediate conveyor belt, and for then transferring the complete array to said transfer conveyor belt. In yet another embodiment, in order to achieve a higher transfer rate in addition to the mentioned intermediate buffer effect, the transfer means of the loading unit further comprise a set of intermediate conveyor belts mutually arranged in parallel for receiving respective partial arrays of slices from the end of the array-forming conveyor belts and thus forming together a complete array of slices on said set of intermediate conveyor belts, and for then transferring it to said transfer conveyor belt.

The term "conveyor belt" is used throughout this description to refer to a conveyor device providing a mobile surface, either an endless band assembled on rollers or a plurality of parallel endless straps, wires or cords assembled on pulleys, or another similar device.

In a preferred embodiment, the moving conveying surface is provided by a tray provided with a permeable support surface, such as, for example, a mesh or a surface provided with perforations or openings. In accordance, a tray conveyor is arranged for moving successive trays under the end of said transfer conveyor belt, in the same direction and at the same speed as the forward movement direction and speed thereof, such that each tray receives one of the complete arrays of slices from the transfer conveyor belt. The empty trays are fed from an empty tray supply line, and a transfer device is arranged for transferring empty trays from said empty tray supply line to said tray conveyor before the trays are loaded. In an alternative embodiment, the moving conveying surface is a continuous conveyor belt or successive sections of conveyor belt, each assembled on an autonomous chassis adapted for being conveyed by a conveyor device.

The mentioned movement means for aligning the start of each of the array-forming conveyor belts with the outlet of the slicing machine preferably comprise means for jointly moving the set of array-forming conveyor belts in a direction transverse to the forward movement direction while the slicing machine and the moving conveying surface are in stationary positions. If the transfer means comprise the transfer conveyor belt, the latter will also be in a stationary position. If the transfer means comprise the intermediate conveyor belt or the set of intermediate conveyor belts, this or these latter will move in the direction transverse to the forward movement direction together with the set of array-forming conveyor belts. Alternatively, if the slicing machine is light enough, the movement means can comprise means for moving only the slicing machine, or a part thereof including the outlet, in a direction transverse to the forward movement direction while the set of array-forming conveyor belts and the line of the moving conveying surface are in stationary positions. If the transfer means comprise the transfer conveyor belt and/or the intermediate conveyor belt or the set of intermediate conveyor belts, these latter will also be in stationary positions.

According to a second aspect, the present invention provides a method for cutting slices of a food product and loading them on a conveying surface, of the type comprising the steps of cutting slices from at least one piece of food product, and receiving said slices coming from said slicing machine on at least one conveyor belt of a loading unit and loading them on a moving conveying surface. The method of the present invention is characterized in that said step of cutting comprises cutting rows of slices from a number of pieces of food product arranged in parallel, and in that it further comprises the following steps. First, an outlet of the slicing machine is aligned with a first array-forming conveyor belt of a set of array-forming conveyor belts arranged in parallel and depositing from the slicing machine successive rows of slices arranged in a direction transverse to the forward movement direction on said first array-forming conveyor belt while the same is made to move forward synchronously with the operation of the slicing machine until forming a first partial array of slices on the first array-forming conveyor belt. Then, the outlet of the slicing machine is aligned with the start of a second array-forming conveyor belt of said set of array-forming conveyor belts and a second partial array of slices is similarly formed on said second array-forming conveyor belt. The same operations are performed in relation to subsequent array-forming conveyor belts, if there are any, of the set of array-forming conveyor belts for forming corresponding partial arrays thereon. The set of the partial arrays arranged on the array-forming conveyor belts forms a complete array of slices which, according to the method, is then transferred from the array-forming conveyor belts to said moving conveying surface.

The mentioned step of transferring each complete array of slices comprises receiving the complete array of slices coming from the array-forming conveyor belts in a transfer conveyor belt and then transferring the complete array of slices from said transfer conveyor belt to the moving conveying surface located under the end of said transfer conveyor belt and being moved in the same direction and at the same speed as the forward movement direction and speed of the transfer conveyor belt. The step of transferring each complete array of slices preferably comprises the intermediate step of jointly transferring the partial arrays of slices from the end of the array-forming conveyor belts to an intermediate conveyor belt and then transferring the complete array of slices thus formed on said intermediate conveyor belt from the end of the intermediate conveyor belt to the transfer conveyor belt. Alternatively, instead of a single intermediate conveyor belt, a set of intermediate conveyor belts arranged in parallel can be used, each aligned with a corresponding conveyor belt of the set of array-forming conveyor belts for receiving the complete array of slices from the end of the array-forming conveyor belts and then transferring it from the end of the intermediate conveyor belts to the transfer conveyor belt.

The method preferably comprises using as a conveying surface successive trays provided with a permeable support surface and moving said trays under the end of said transfer conveyor belt, in the same direction and at the same speed as the forward movement direction and speed of the transfer conveyor belt, for receiving one of the complete arrays of slices from the transfer conveyor belt on each tray. Obviously, the complete array of slices is configured and sized to maximally occupy the support surface of the tray with the slices arranged in a single layer.

According to a third aspect, the present invention provides a treatment plant for treating a food product cut into slices, of the type comprising a cutting and loading unit for cutting slices of food product and loading them on a conveying surface, a conveyor device for conveying said conveying surface loaded with slices along a path including the passage through one or more treating units, an unloading unit for unloading the treated slices from the conveying surface, and one or more packaging units for packaging the unloaded slices. The plant is characterized in that said cutting and loading unit includes an apparatus for cutting slices of a food product and loading them on a moving conveying surface according to the first aspect of the present invention.

In one embodiment, the plant of the present invention is prepared for treating a food product in the form of a sausage meat product cut into slices, and said at least one treating unit is a drying and maturing unit for drying and maturing said meat product cut into slices. For a relatively tender sausage meat product, i.e., with a relatively low curing level, the plant may only include one or more forced convection heat treating units as treating units. For a meat product with a relatively high curing level, the plant can further include one or more autoclaves for a treatment in modified atmospheric conditions and/or in modified atmosphere.

The loading unit is preferably prepared for loading the slices of food product on successive large trays provided with a permeable support surface, and the plant includes a conveyor device configured for conveying the trays loaded with the slices along the path including the passage through the one or more treating units. Once the slices are unloaded from the trays at the end of the treating line, the empty trays are directed by a conveyor again towards the loading unit, passing through a tray washing unit.

BRIEF DESCRIPTION OF THE DRAWINGS

The previous and other features and advantages will be more fully understood from the following detailed description of several embodiments with reference to the attached drawings, in which.

DETAILED DESCRIPTION OF EXEMPLARY EMBODIMENTS

Figure 1:
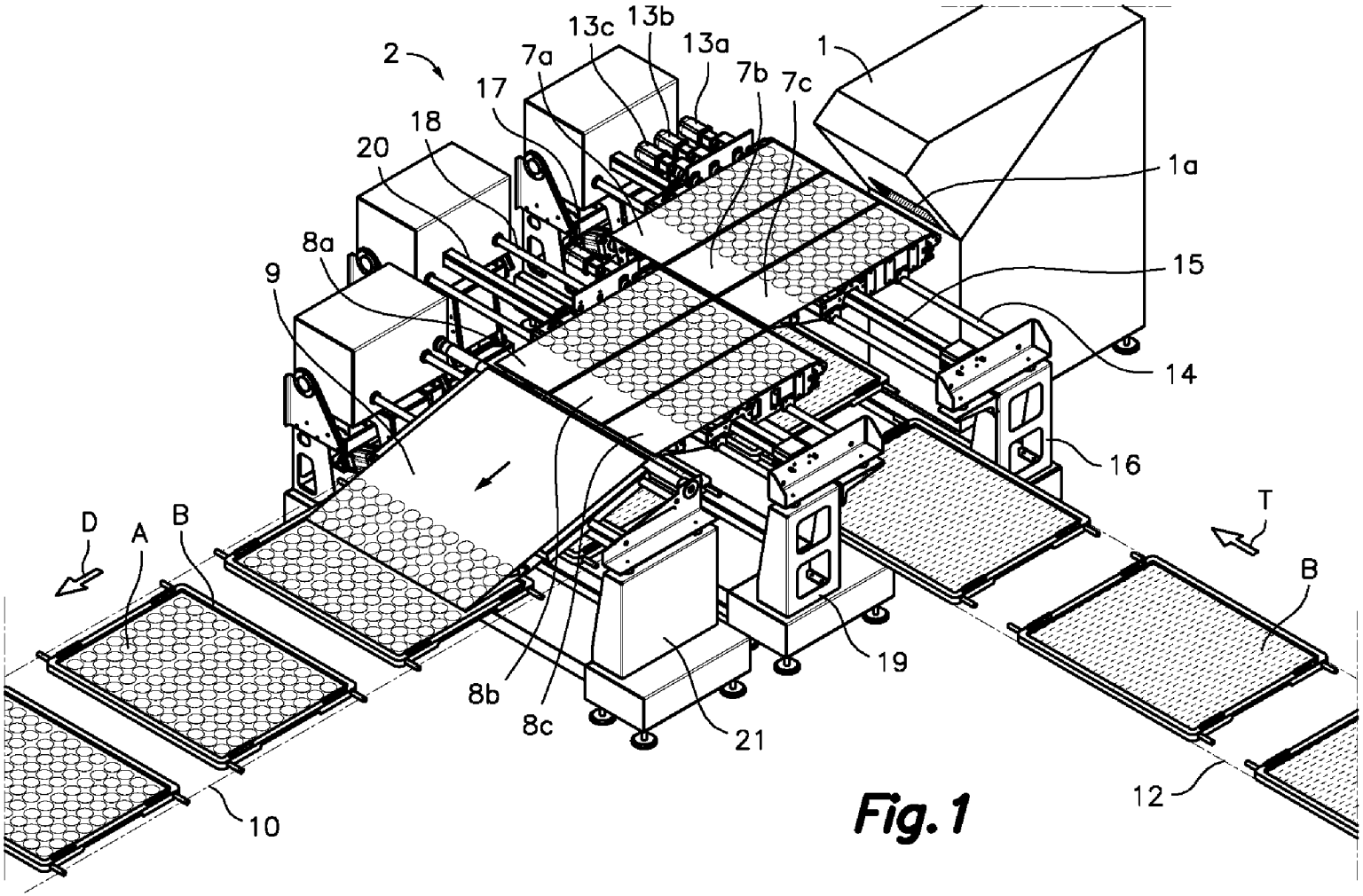
FIG. 1 is a simplified perspective view of the apparatus for cutting slices of a food product and loading them on a conveying surface according to an embodiment of the first aspect of the present invention.
Figure 2:
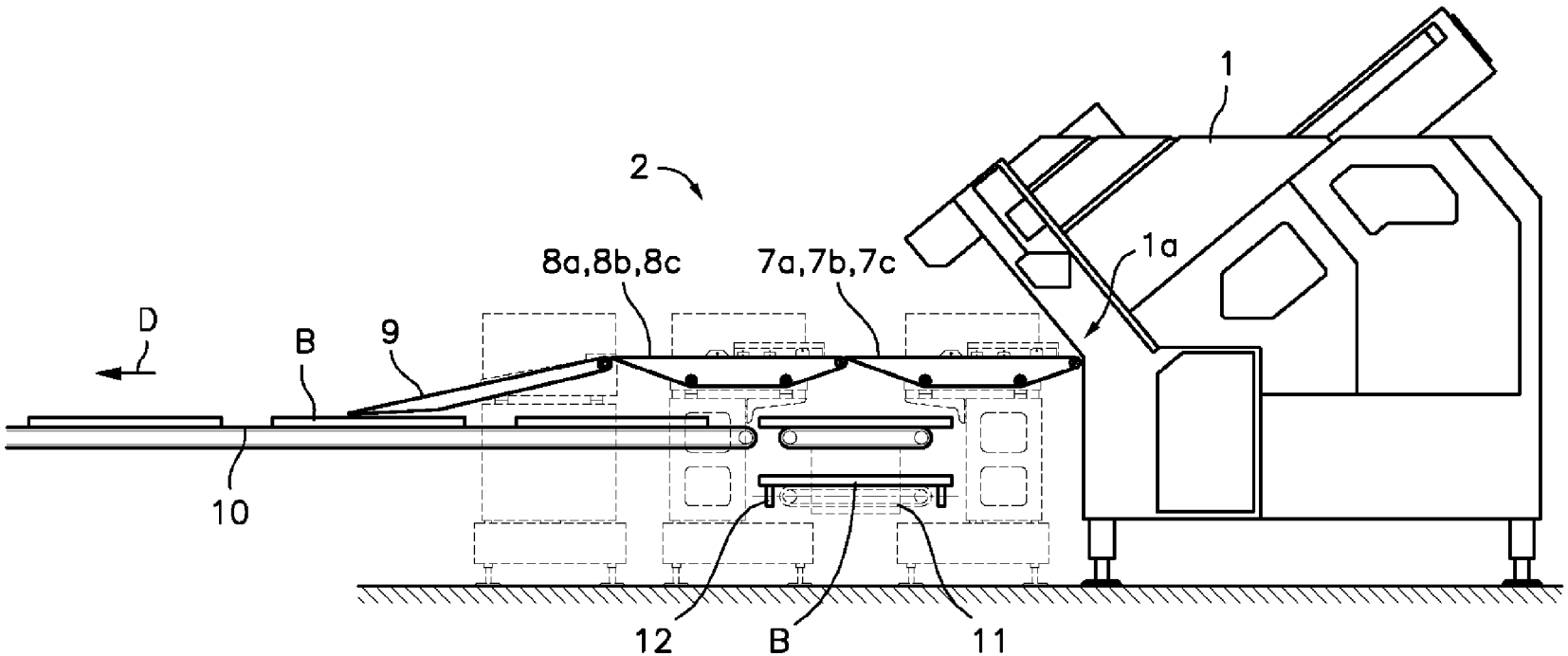
FIG. 2 is a simplified side view of the apparatus of FIG. 1.

Referring first to FIGS. 1 and 2, the apparatus for cutting slices of a food product and loading them on a conveying surface comprises, according to an embodiment of the first aspect of the present invention, a slicing machine 1 adapted for cutting rows of slices A from a number of pieces of food product arranged in parallel and a loading unit 2 arranged for receiving said slices A from said slicing machine 1 and loading them on a moving conveying surface provided, in the illustrated example, by a plurality of large trays B having a permeable support surface and moved by a known type of tray conveyor 10 (schematically depicted by means of dashed lines in FIG. 1). The mentioned trays B are configured to be conveyed along a path including the passage through one or more treating units, such as, for example, one or more forced convection treating units and/or one or more treating units in modified atmospheric conditions, in which the slices A of food product loaded on the trays B are subjected to treatment.

The mentioned loading unit 2 comprises a set of three array-forming conveyor belts 7*a*, 7*b*, 7*c* arranged in parallel, one of which has the start adjacent to an outlet 1*a* of the slicing machine 1, a set of three intermediate conveyor belts 8*a*, 8*b*, 8*c* arranged in parallel and following the three array-forming conveyor belts 7*a*, 7*b*, 7*c*, and a transfer conveyor belt 9 arranged following the three intermediate conveyor belts 8*a*, 8*b*, 8*c*. The conveying surfaces of all the conveyor belts of the loading unit 2 are driven to be moved in a forward movement direction indicated by means of the arrow D.

As is best seen in FIG. 2, the array-forming conveyor belts 7*a*, 7*b*, 7*c* have a sharp end arranged very close to and substantially at the same level as the start of the intermediate conveyor belts 8*a*, 8*b*, 8*c*, and the latter also have a very sharp end arranged very close to and substantially at the same level as the start of the mentioned transfer conveyor belt 9. The transfer conveyor belt 9 is inclined and has a sharp end arranged above and very close to the trajectory described by the trays B when they are moved by the tray conveyor 10 in said forward movement direction D. Therefore, the array-forming conveyor belts 7*a*, 7*b*, 7*c*, the intermediate conveyor belts 8*a*, 8*b*, 8*c* and the transfer conveyor belt 9 are capable of transferring the slices A from the outlet 1*a* of the slicing machine 1 to the support surface of the moving trays B, according to a method which will be described in detail below.

The slicing machine 1 is in a stationary position. The three array-forming conveyor belts 7*a*, 7*b*, 7*c* are installed in respective chassis and actuated individually by respective motors 13*a*, 13*b*, 13*c* for moving their respective conveying surfaces in the forward movement direction D. The mentioned chassis of the three array-forming conveyor belts 7*a*, 7*b*, 7*c* are assembled in a sliding manner on guide members 14 supported on a frame 16 and fixed to a transmission belt 15 actuated by a motor (not shown) for jointly moving the three array-forming conveyor belts 7*a*, 7*b*, 7*c* along said guide members 14 in a direction transverse to the forward movement direction D. Similarly, the three intermediate conveyor belts 8*a*, 8*b*, 8*c* are installed in respective chassis and actuated in this case by a single motor 17 for moving in unison their respective conveying surfaces in the forward movement direction D. The mentioned chassis of the three intermediate conveyor belts 8*a*, 8*b*, 8*c* are assembled in a sliding manner on guide members 18 supported on a frame 19 and fixed to a transmission belt 20 actuated by a motor (not shown) for jointly moving the three intermediate conveyor belts 8*a*, 8*b*, 8*c* along said guide members 18 in a direction transverse to the forward movement direction D. The transfer conveyor belt 9 is installed in a stationary position in a rack 21 and actuated by a motor (not shown) for moving its conveying surface in the forward movement direction D.

In the illustrated example, the slicing machine 1 is adapted for cutting four pieces of food product at the same time in each cutting operation, such that successive rows of four slices A are supplied through the outlet 1*a* of the slicing machine 1 at a predetermined rate. The rows of slices A are aligned in a direction transverse to the forward movement direction D and the width of each of the array-forming conveyor belts 7*a*, 7*b*, 7*c* and of each of the intermediate conveyor belts 8*a*, 8*b*, 8*c* is sized according to the length of a row of four slices. By transversely moving the set of array-forming conveyor belts 7*a*, 7*b*, 7*c*, each of them can be successively aligned with the outlet 1*a* of the slicing machine 1. The operation of the slicing machine 1 will be stopped for brief periods to allow the transverse movement of the set of array-forming conveyor belts 7*a*, 7*b*, 7*c*. When one of the array-forming conveyor belts 7*a*, 7*b*, 7*c* is aligned with the outlet 1*a* of the slicing machine 1, the rows of slices A are deposited thereon as they are cut, and by making the support surface of the corresponding array-forming conveyor belt move forward synchronously with the operation of the slicing machine 1, a partial array of slices A is formed on the array-forming conveyor belt. In the illustrated example, the mentioned partial array of slices comprises nine rows of four slices A.

Then, the forward movement of the conveying surface of the array-forming conveyor belt stops and the set of the three array-forming conveyor belts 7*a*, 7*b*, 7*c* is moved transversely to align the next array-forming conveyor belt with the outlet 1*a* of the slicing machine 1 for forming another partial array of slices A thereon. After repeating these operations for each of the three array-forming conveyor belts 7*a*, 7*b*, 7*c*, a complete array of slices A made up of the three partial arrays arranged on the three array-forming conveyor belts 7*a*, 7*b*, 7*c* is obtained. In the illustrated example, the complete array of slices A comprises nine rows of twelve slices A and is foreseen to maximally occupy the support surface of the tray A with the slices A arranged in a single layer. By moving the set of array-forming conveyor belts 7*a*, 7*b*, 7*c* and/or the set of intermediate conveyor belts 8*a*, 8*b*, 8*c* in the direction transverse to the forward movement direction D, the array-forming conveyor belts 7*a*, 7*b*, 7*c* with the intermediate conveyor belts 8*a*, 8*b*, 8*c* can be aligned, and when they are aligned, the complete array of slices A can be transferred from the array-forming conveyor belts 7*a*, 7*b*, 7*c* to the intermediate conveyor belts 8*a*, 8*b*, 8*c*. By moving the set of intermediate conveyor belts 8*a*, 8*b*, 8*c* in the direction transverse to the forward movement direction D the intermediate conveyor belts 8*a*, 8*b*, 8*c* can be aligned with the transfer conveyor belt 9, and when they are aligned, the complete array of slices A can be transferred from the intermediate conveyor belts 8*a*, 8*b*, 8*c* to the transfer conveyor belt 9.

The tray conveyor 10 is arranged for moving the successive trays B under the end of the transfer conveyor belt 9 in the forward movement direction D and at the same speed as the speed of forward movement of the conveying surface of the transfer conveyor belt 9, such that the successive complete arrays of slices A are transferred from the transfer conveyor belt 9 to the successive moving trays B. The mentioned frames 16, 19 supporting the sets of array-forming conveyor belts 7*a*, 7*b*, 7*c* and intermediate conveyor belts 8*a*, 8*b*, 8*c* have opposing side notches providing a passage for an empty tray supply line 12 (schematically depicted by means of dashed lines in FIG. 1) by means of which successive empty trays B are introduced in the loading unit 2 in a direction T transverse to the forward movement direction D and located in alignment with the tray conveyor 10 at a lover level than the same. A known type of transfer device 11 (schematically depicted by means of dashed lines in FIG. 2) is arranged for transferring the empty trays B from said empty tray supply line 12 to the tray conveyor 10.

It will be understood, for example, that the slicing machine 1 could alternatively be configured for cutting rows of slices A made up of a number of slices different from four and/or that the partial arrays or the complete array could have a number of rows different from nine.

Also, the sets of array-forming conveyor belts and of intermediate conveyor belts could each have only two or more than three conveyor belts. Another possible alternative variant would be for the several intermediate conveyor belts 8*a*, 8*b*, 8*c* to be actuated individually instead of being actuated in unison, such that the partial arrays of slices could be transferred individually from the array-forming conveyor belts 7*a*, 7*b*, 7*c* to the intermediate conveyor belts 8*a*, 8*b*, 8*c* as they were formed instead of transferring the complete array of slices. It will also understood that the moving conveying surface on which the complete arrays of slices A are deposited could alternatively be provided by a mobile support surface of a conveyor belt or another equivalent conveyor arranged under the end of the transfer conveyor belt 9 instead of the trays B moved by the tray conveyor 10. The set of array-forming conveyor belts 7*a*, 7*b*, 7*c*, the set of intermediate conveyor belts 8*a*, 8*b*, 8*c* and the transfer conveyor belt 9 could also alternatively be in stationary positions and the apparatus could include means for moving the slicing machine 1 in a direction transverse to the forward movement direction for successively aligning the outlet 1*a* of the slicing machine 1 with the start of the array-forming conveyor belts 7*a*, 7*b*, 7*c*.

As is schematically shown in FIGS. 3 to 6, the apparatus of the present invention is susceptible of several alternative embodiments different from the one shown and described in relation to FIGS. 1 and 2.

Figure 3:
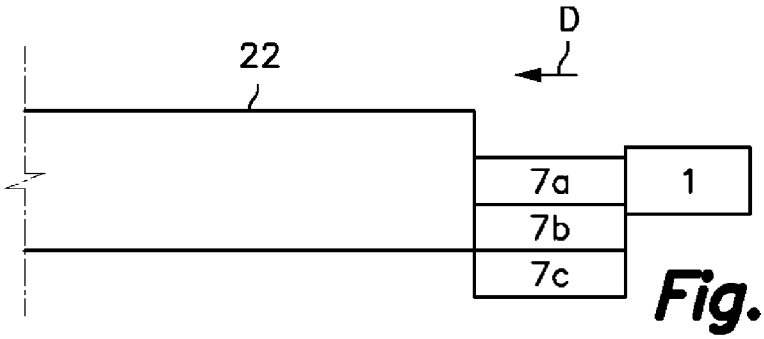
FIGS. 3 to 6 are schematic plan views of different alternative embodiments of the apparatus of the present invention.

In the alternative embodiment of FIG. 3, the apparatus comprises only the slicing machine 1 and the set of array-forming conveyor belts 7*a*, 7*b*, 7*c*, such that the complete array of slices A formed by the partial arrays is transferred directly from the array-forming conveyor belts 7*a*, 7*b*, 7*c* to the moving conveying surface, which in this example is provided by the mobile support surface of an outlet conveyor belt 22 or another equivalent conveyor. In this case, the operation of the slicing machine 1 will be interrupted for sufficient periods to allow the transverse movements of the set of array-forming conveyor belts 7*a*, 7*b*, 7*c* and the transfer of the complete array of slices to said mobile support surface of the outlet conveyor belt 22.

Figure 4:
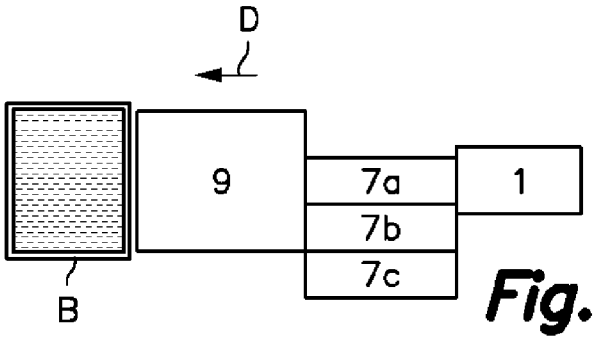

In the alternative embodiment of FIG. 4, the apparatus comprises only the slicing machine 1, the set of array-forming conveyor belts 7*a*, 7*b*, 7*c*, and the transfer conveyor belt 9, such that the complete array of slices A formed by the partial arrays is first transferred from the array-forming conveyor belts 7*a*, 7*b*, 7*c* to the transfer conveyor belt 9, and after from the transfer conveyor belt 9 to the moving conveying surface, which in this example is provided by the support surface of a tray B moved by a tray conveyor.

Figure 5:
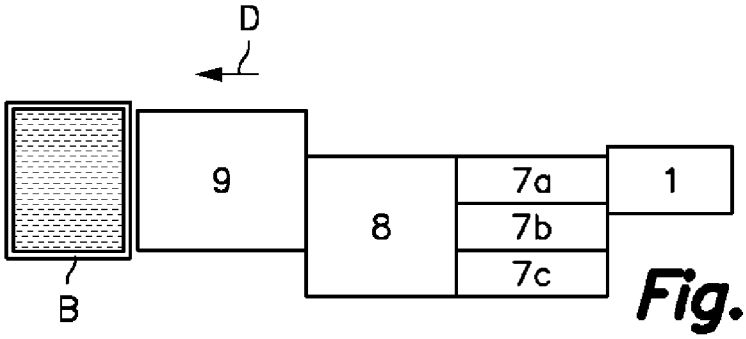

The composition of the apparatus in the alternative embodiment of FIG. 5 is similar to that described above in relation to FIGS. 1 and 2 except in that here, instead of the set of intermediate conveyor belts 8*a*, 8*b*, 8*c* there is a single intermediate conveyor belt 8 with a width equivalent to the combined widths of the array-forming conveyor belts 7*a*, 7*b*, 7*c* and to the width of the transfer conveyor belt 9. The intermediate conveyor belt 8 performs a temporary storage function of the complete array of slices which allows absorbing and regulating possible mismatching in the synchronization of the movements of the different devices.

Figure 6:
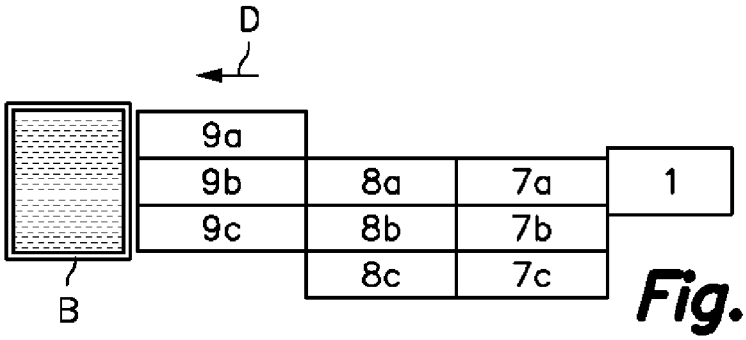
Figure 7:
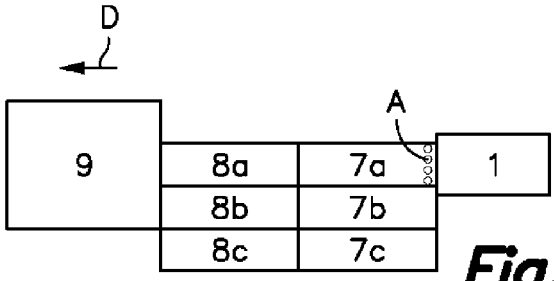
FIGS. 7 to 16 are schematic plan views showing successive steps in a method for cutting slices of a food product and loading them on a conveying surface according to an embodiment of the second aspect of the present invention using the apparatus of FIGS. 1 and 2.

The composition of the apparatus in the alternative embodiment of FIG. 6 is similar to that described above in relation to FIGS. 1 and 2 except in that here, instead of a single transfer conveyor belt 9, there is a set of transfer conveyor belts 9*a*, 9*b*, 9*c* with a width equivalent to the width of the set of intermediate conveyor belts 8*a*, 8*b*, 8*c*. The several intermediate conveyor belts 8*a*, 8*b*, 8*c* and the several transfer conveyor belts 9*a*, 9*b*, 9*c* can be actuated in unison or individually for transferring the complete array of slices or the partial arrays from some belts to the other belts. Nevertheless, the several transfer conveyor belts 9*a*, 9*b*, 9*c* will be actuated in unison for transferring the complete array of slices from the transfer conveyor belts 9*a*, 9*b*, 9*c* to the tray B. Alternatively, in the apparatuses shown in FIGS. 4 and 5, the single transfer conveyor belt 9 can also be replaced by a set of transfer conveyor belts 9*a*, 9*b*, 9*c* like that shown in FIG. 6.

It will be understood that, in the apparatus shown in FIG. 3, the mobile conveying surface of the outlet conveyor belt 22 could alternatively be replaced by successive trays moved by a tray conveyor. It will also be understood that, in the apparatuses of FIGS. 4, 5 and 6, the successive trays B moved by a tray conveyor could alternatively be replaced by a mobile conveying surface of an outlet conveyor belt.

Figure 8:
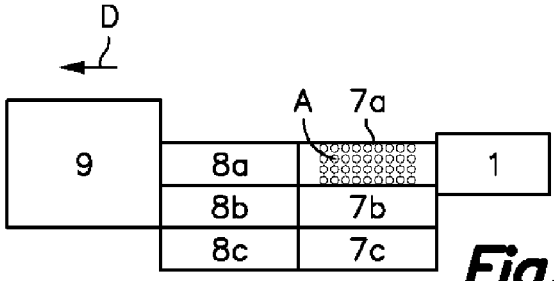
Figure 9:
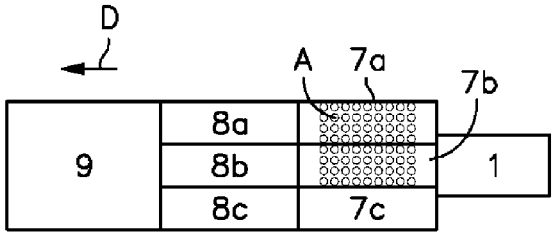
Figure 10:
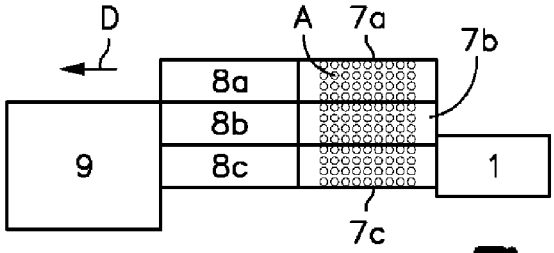

Now in relation to FIGS. 7 to 16, a method for cutting slices of a food product and loading them on a conveying surface using the apparatus described above in relation to FIGS. 1 and 2 is described. When the apparatus initially starts up (FIG. 7), the set of array-forming conveyor belts 7*a*, 7*b*, 7*c* and the set of intermediate conveyor belts 8*a*, 8*b*, 8*c* are transversely moved for aligning a first array-forming conveyor belt 7*a* with the outlet of the slicing machine 1 and the slicing machine 1 starts the cutting operations for depositing rows of slices A on the conveying surface of the first array-forming conveyor belt 7*a* while the latter moves in the forward movement direction D until forming a first partial array of slices A on the first array-forming conveyor belt 7*a* (FIG. 8). Then, the set of array-forming conveyor belts 7*a*, 7*b*, 7*c* and the set of intermediate conveyor belts 8*a*, 8*b*, 8*c* are transversely moved for aligning a second array-forming conveyor belt 7*b* with the outlet of the slicing machine 1 and the operations for forming a second partial array of slices A on the second array-forming conveyor belt 7*b* (FIG. 9) are repeated. Next, similar operations necessary for aligning a third array-forming conveyor belt 7*c* with the outlet of the slicing machine 1 and for forming a third partial array of slices A on the third array-forming conveyor belt 7*c* (FIG. 10) are performed.

Figure 12:
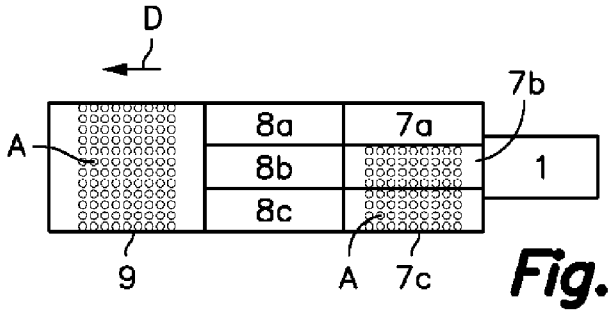
Figure 13:
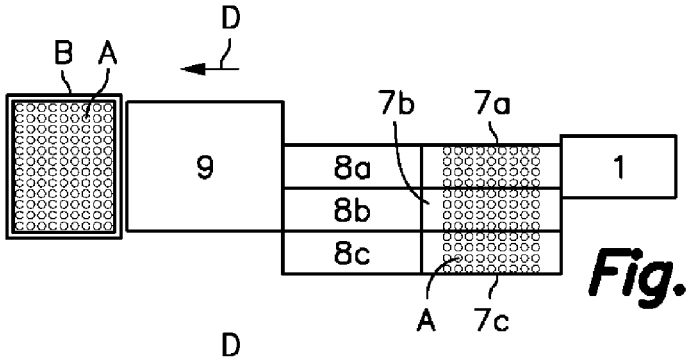
Figure 14:
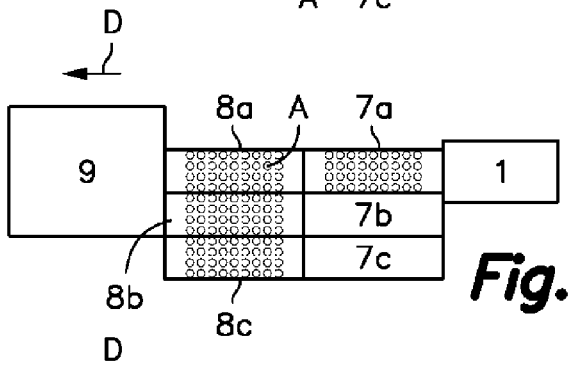

Now, the first, second and third partial arrays arranged on the first, second and third array-forming conveyor belts 7*a*, 7*b*, 7*c* together form a first complete array, which is transferred to the corresponding intermediate conveyor belts 8*a*, 8*b*, 8*c* and immediately, without the set of array-forming conveyor belts 7*a*, 7*b*, 7*c* and the set of intermediate conveyor belts 8*a*, 8*b*, 8*c* being transversely moved, the operations for forming a new first partial array on the third array-forming conveyor belt 7*c* (FIG. 11) are performed. Then, the set of array-forming conveyor belts 7*a*, 7*b*, 7*c* and the set of intermediate conveyor belts 8*a*, 8*b*, 8*c* are transversely moved for aligning the second array-forming conveyor belt 7*b* with the outlet of the slicing machine 1 and the operations necessary for forming a new second partial array of slices A on the second array-forming conveyor belt 7*c* are performed while the first complete array of slices A is transferred from the intermediate conveyor belts 8*a*, 8*b*, 8*c* to transfer conveyor belt 9 (FIG. 12). Then similar operations for aligning the first array-forming conveyor belt 7*a* with the outlet of the slicing machine 1 and for forming a new third partial array of slices A on the first array-forming conveyor belt 7*a* are performed while the first complete array of slices A is transferred from the transfer conveyor belt 9 to a first moving tray B (FIG. 13).

Figure 15:
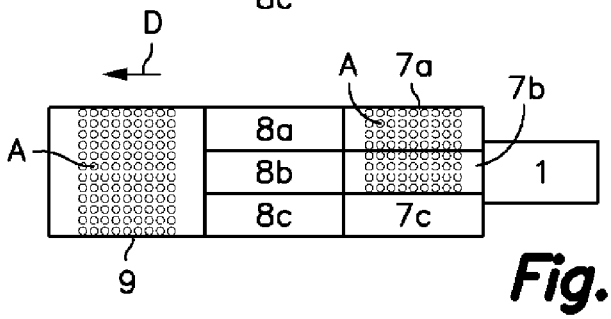
Figure 16:
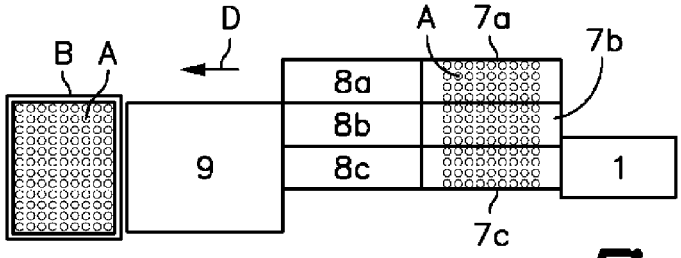

Now, the new third, second and first partial arrays arranged on the first, second and third array-forming conveyor belts 7*a*, 7*b*, 7*c* together form a second complete array, which is transferred to the corresponding intermediate conveyor belts 8*a*, 8*b*, 8*c*, and immediately, without the set of array-forming conveyor belts 7*a*, 7*b*, 7*c* and the set of intermediate conveyor belts 8*a*, 8*b*, 8*c* being transversely moved, the operations necessary for forming a new first partial array on the first array-forming conveyor belt 7*a* (FIG. 14) are performed. Then, the set of array-forming conveyor belts 7*a*, 7*b*, 7*c* and the set of intermediate conveyor belts 8*a*, 8*b*, 8*c* are transversely moved for aligning the second array-forming conveyor belt 7*b* with the outlet of the slicing machine 1 and the operations necessary for forming a new second partial array of slices A on the second array-forming conveyor belt 7*c* are performed while the second complete array of slices A is transferred from the intermediate conveyor belts 8*a*, 8*b*, 8*c* to transfer conveyor belt 9 (FIG. 15). Next, similar operations for aligning the third array-forming conveyor belt 7*c* with the outlet of the slicing machine 1 and for forming a new third partial array of slices A on the third array-forming conveyor belt 7*c* are performed while the second complete array of slices A is transferred from the transfer conveyor belt 9 to a second moving tray B (FIG. 16).

Figure 11:
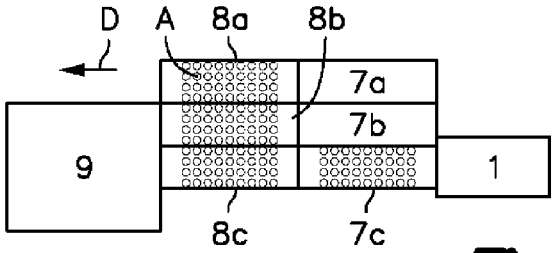

Now, there is a third complete array of slices A on the array-forming conveyor belts 7*a*, 7*b*, 7*c*, and from the position shown in FIG. 16, the sequence again goes to the position shown in FIG. 11. From here, the steps described in relation to FIGS. 11 to 16 are cyclically repeated for cutting slices of the food product and loading them on successive trays using the apparatus described above in relation to FIGS. 1 and 2. Variants for applying the method of the invention will occur to a person skilled in the art using an apparatus according to the embodiment and any of its variants described in relation to the apparatus of FIGS. 1 and 2, or an apparatus according to any of the embodiments and variants described in relation to FIGS. 3 to 6 without departing from the scope of the present invention.

Figure 17:
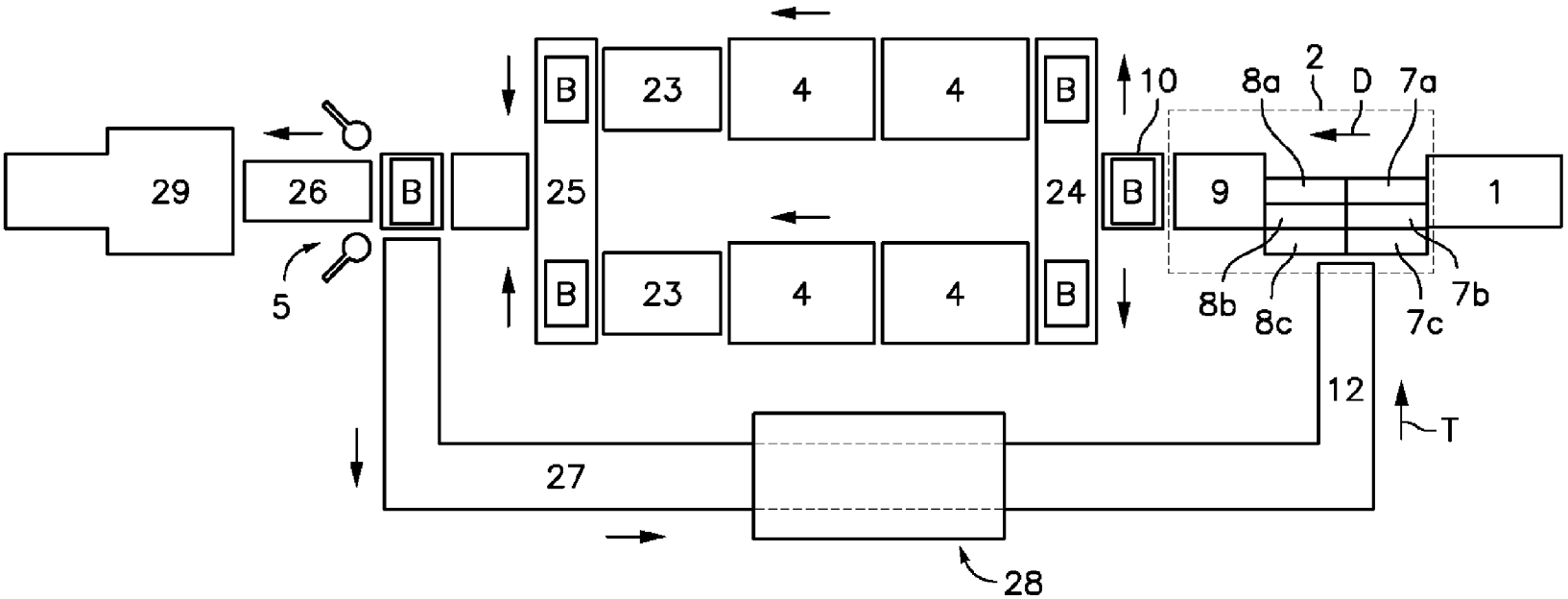
FIG. 17 is a schematic layout of a treatment plant for a food product cut into slices according to an embodiment of the third aspect of the present invention.

In relation to FIG. 17, a treatment plant for a food product cut into slices is described below according to an embodiment of the third aspect of the present invention. The plant of FIG. 17 is envisaged, for example, for treating a sausage meat product which, when it is still raw and uncured, is cooled at a low enough temperature to facilitate cutting it into slices. The plant comprises a slicing machine 1 for cutting the cooled meat product and a loading unit 2 arranged for receiving the cut slices from said slicing machine 1 and loading them on a plurality of large trays B provided with a permeable support surface and moved by a tray conveyor 10. The slicing machine 1, the loading unit 2 and the arrangement of the tray conveyor 10 are like those of the apparatus described above in relation to FIGS. 1 and 2, though they can alternatively be according to any one of the embodiments and variants of the apparatus of the first aspect of the present invention described above. The tray conveyor 10 forms part of a system of conveyors arranged for conveying successive loaded trays B with slices along a path which includes the passage through one or more treating units 4 in which the slices are treated.

In the illustrated example, the plant includes two drying and maturing lines, each of which includes two consecutive treating units 4 and an intermediate storage device 23. Between the tray conveyor 10 and the start of the two drying and maturing lines there is arranged an inlet distributor 24 for distributing loaded trays B with slices of food product coming from the loading unit 2 towards the treating units 4 of the two drying and maturing lines. At the end of the two drying and maturing lines there is arranged an outlet distributor 25 for distributing the loaded trays B coming from the treating units 4 of each of the drying and maturing lines towards an unloading unit 5 configured for unloading the treated slices from the trays B. The unloaded slices are delivered to an accumulation and cooling device 26 whereas the empty trays B are delivered to an empty tray conveyor 27, which is a return conveyor in connection with the empty tray conveyor 12 supplying empty trays B to the loading unit 2. The course of this return conveyor includes a passage through a tray washing unit 28 in which the empty trays B are washed before being used again.

The treated slices of food product are led by conveyor means from said accumulation and cooling device 26 to a packaging unit 29 which includes, for example, a thermoformer or a vacuum packaging device, in which the slices are packaged. The unloading unit 5 can comprise one or more robotic arms configured to handle gripping members based, for example, on suction cups. The unloading unit 5 can alternatively comprise a bridge handler for handling a gripping member in which there is arranged an array of suction cups coinciding with the complete array of slices arranged on the support surface of each tray B.

The plant of the embodiment shown in FIG. 17 is suitable for preparing a relatively tender sausage meat product, i.e., with a low curing level, such as a salami or the like, cut into slices. To that end, the two treating units 4 of each drying and maturing line are a known type of forced convection treating units. Each of said forced convection treating units defines a treating chamber in which conditioned air or another gas is circulated and it is equipped with internal conveyor means configured for moving the loaded trays B with slices along a path designed so that it is as long as possible inside the treating chamber for the purpose of subjecting the slices to the action of the forced convection for a sufficient time for the desired curing level. Depending on the curing time necessary for each type of sausage meat product, each drying and maturing line can include one, two or more consecutive forced convection treating units. When the sausage meat products to be treated require a high curing level, the drying and maturing lines can additionally include known types of treating units in modified atmospheric conditions. The slicing machine 1 and the loading unit 2 are capable of supplying loaded trays B with slices of food product at a sufficient rate for feeding the two drying and maturing lines. In some cases, for example when the food product requires a very high curing level, the slicing machine 1 and the loading unit 2 are capable of feeding three or more drying and maturing lines. Nevertheless, the plant can include only one drying and maturing line if desired.

The intermediate storage devices 23 serve to regulate the transit of loaded trays B between the respective treating units 4 and the outlet distributor 25. Thus, for example, if the flow of trays B through one of the treating units 4 is momentarily interrupted, the rest of the line downstream would continue operating regularly with the trays B previously accumulated in the corresponding intermediate storage device 23, which would be supplied to the outlet distributor 25. Similarly, if the flow of trays B downstream from one of the treating units 4 is momentarily interrupted, the flow through the treating unit 4 would continue operating regularly and the trays B coming out of the treating unit 4 would be temporarily accumulated in the corresponding intermediate storage device 23.

A person skilled in the art will be able to make modifications and variations in the embodiments shown and described without departing from the scope of the present invention as it is defined in the attached claims.

What is claimed is:

1. An apparatus for cutting slices of a food product and loading them on successive moving trays, comprising:

a slicing machine for cutting slices from a plurality of pieces of food product arranged in parallel, said slicing machine being arranged in a stationary position and having an outlet outputting rows of slices, each row of slices comprising a plural number of slices arranged on single layer; and a loading unit including:

a set of individually actuated array-forming conveyor belts arranged in parallel, each of said array-forming conveyor belts being actuated in a forward movement direction synchronously with the operation of said slicing machine and sized in width to receive rows of slices cut at once by the slicing machine arranged in a direction transverse to said forward movement direction;

movement means for jointly moving said set of array-forming conveyor belts in a direction transverse to said forward movement direction for successively locating one empty array-forming conveyor belt of said set of array-forming conveyor belts in alignment with said outlet of said slicing machine for successively receiving one partial array of slices formed by a plural number of parallel rows of slices cut at once by the slicing machine on each array-forming conveyor belt;

transfer means associated to the set of array-forming conveyor belts for transferring a complete array of slices formed by said partial arrays received on the set of array-forming conveyor belts from the array-forming conveyor belts to one moving tray of said successive moving trays, each of said moving trays having a permeable support surface to support the slices; and a tray conveyor arranged for moving a plurality of the successive moving trays in coordination with said transfer means, wherein each row of slices in the complete array of slices comprises a number of slices which is a multiple of the number of slices in a row of slices cut at once by the slicing machine.

2. The apparatus according to claim 1, wherein said transfer means of the loading unit comprise at least one transfer conveyor belt arranged for receiving said complete array of slices formed by said partial arrays coming from the set of array-forming conveyor belts and transferring the complete array of slices to the moving tray.

3. The apparatus according to claim 2, wherein said tray conveyor is arranged for moving the successive trays under the end of said transfer conveyor belt, in a same direction and at a same speed as the forward movement direction and speed of said transfer conveyor belt, for receiving one of the complete arrays of slices from the transfer conveyor belt on each tray.

4. The apparatus according to claim 3, wherein a transfer device is arranged for transferring empty trays from an empty tray supply line to said tray conveyor.

5. The apparatus according to claim 2, wherein the transfer means of the loading unit further comprise at least one intermediate conveyor belt arranged for receiving the partial arrays of slices from an end of the array-forming conveyor belts for together forming a complete array of slices on said intermediate conveyor belt and transferring the complete array of slices to said transfer conveyor belt.

6. The apparatus according to claim 5, wherein the transfer conveyor belt is arranged in a stationary position.

7. The apparatus according to claim 2, wherein the transfer means of the loading unit further comprise a set of intermediate conveyor belts arranged in parallel for receiving respective partial arrays of slices from an end of the array-forming conveyor belts for together forming a complete array of slices on said set of intermediate conveyor belts and transferring the complete array of slices to said transfer conveyor belt.

8. The apparatus according to claim 7, wherein the transfer conveyor belt is arranged in a stationary position.

9. A method for cutting slices of a food product and loading them on successive moving trays, comprising the steps of:

cutting rows of slices from a number of pieces of food product arranged in parallel with a slicing machine arranged in a stationary position and having an outlet outputting said rows of slices, each row of slices comprising a plural number of slices arranged on single layer; and jointly moving a set of individually actuated parallel arranged array-forming conveyor belts in a direction transverse to a forward movement direction thereof for successively locating one empty array-forming conveyor belt of said set of array-forming conveyor belts in alignment with said outlet of said slicing machine, each of said array-forming conveyor belts being sized in width to receive rows of slices cut at once by the slicing machine arranged in a direction transverse to said forward movement direction;

successively actuating the array-forming conveyor belt which is in alignment with the outlet of the slicing machine in said forward movement direction synchronously with operation of the slicing machine for depositing a partial array of slices formed by a plural number of parallel rows of slices cut at once by the slicing machine arranged on single layer output from the outlet of the slicing machine on the array-forming conveyor belt until one partial array of slices is arranged on each array-forming conveyor; and jointly transferring by means of transfer means associated to the set of array-forming conveyors the partial arrays of slices from the array-forming conveyors to one of the moving trays moved by a tray conveyor in coordination with said transfer means, each of said moving trays having a permeable support surface to support the slices, the partial arrays of slices forming together a complete array of slices arranged on a single layer on the moving tray, wherein each row of slices in the complete array of slices comprises a number of slices which is a multiple of the number of slices in a row of slices cut at once by the slicing machine.

10. The method according to claim 9, wherein said step of transferring the partial arrays of slices, which together form the complete array of slices, comprises receiving said complete array of slices coming from the array-forming conveyor belts on at least one transfer conveyor belt and transferring the complete array of slices from said transfer conveyor belt to one of the trays, with the tray being located under the end of said transfer conveyor belt and being moved by means of said tray conveyor in a same direction and at a same speed as the forward movement direction and speed of the transfer conveyor belt.

11. The method according to claim 10, wherein the step of transferring the partial arrays of slices, which together form the complete array of slices, further comprises an intermediate step of jointly transferring the partial arrays of slices from an end of the array-forming conveyor belts to an intermediate conveyor belt and then transferring the complete array of slices thus formed on said intermediate conveyor belt from an end of the intermediate conveyor belt to the transfer conveyor belt.

12. The method according to claim 10, wherein the step of transferring the partial arrays of slices, which together form the complete array of slices, further comprises an intermediate step of transferring the partial arrays of slices from an end of the array-forming conveyor belts to a set of respective intermediate conveyor belts arranged in parallel and then transferring the complete array of slices thus formed on said set of intermediate conveyor belts from an end of the intermediate conveyor belts to the transfer conveyor belt.

13. A treatment plant for a food product cut into slices, of the type comprising:

a cutting and loading unit including a slicing machine for cutting slices from a plurality of pieces of food product arranged in parallel, said slicing machine being arranged in a stationary position and having an outlet outputting rows of slices, each row of slices comprising a plural number of slices arranged on single layer; and a loading unit including a set of individually actuated array-forming conveyor belts arranged in parallel, each of said array-forming conveyor belts being actuated in a forward movement direction synchronously with the operation of said slicing machine and sized in width to receive rows of slices cut at once by the slicing machine arranged in a direction transverse to said forward movement direction, movement means for jointly moving said set of array-forming conveyor belts in a direction transverse to said forward movement direction for successively locating one empty array-forming conveyor belt of said set of array-forming conveyor belts in alignment with said outlet of said slicing machine for successively receiving one partial array of slices formed by a plural number of parallel rows of slices cut at once by the slicing machine on each array-forming conveyor belt; transfer means associated to the set of array-forming conveyor belts for transferring a complete array of slices formed by said partial arrays received on the set of array-forming conveyor belts from the array-forming conveyor belts to one moving tray of successive moving trays, each of said moving trays having a permeable support surface to support the slices, and each row of slices in the complete array of slices comprising a number of slices which is a multiple of the number of slices in a row of slices cut at once by the slicing machine;

a tray conveyor device arranged for moving a plurality of the successive moving trays in coordination with said transfer means and for conveying said successive movable trays loaded with said complete arrays of slices arranged on a single layer along a path including a passage through at least one treating unit;

an unloading unit for unloading the treated slices from the successive movable trays; and at least one packaging unit for packaging the unloaded slices.

14. The plant according to claim 13, wherein said food product is a sausage meat product and said at least one treating unit comprises a drying and maturing unit for said meat product cut into slices.

* * * * *